US006141821A

United States Patent [19]

Chin

[11] Patent Number: 6,141,821

[45] Date of Patent: Nov. 7, 2000

[54] ASSEMBLY FOR ROLLERS

[76] Inventor: Peter Chin, 35 Sutton St., North Balwyn, Australia, 3104

[21] Appl. No.: 09/082,251

[22] Filed: May 20, 1998

[30] Foreign Application Priority Data

May 21, 1997 [AU] Australia ..... PO6907

[51] Int. Cl.[7] ..... B05C 17/02

[52] U.S. Cl. ..... 15/230.11; 15/230; 492/13; 492/19; D4/122

[58] Field of Search ..... 15/230.11, 230, 15/98, 103.5; 492/13, 16, 17, 19; D32/35; D4/122

[56] References Cited

U.S. PATENT DOCUMENTS

| | | |
|---|---|---|
| 2,187,585 | 1/1940 | Grigas . |
| 3,130,435 | 4/1964 | Smith . |
| 4,198,723 | 4/1980 | Hiller et al. . |

FOREIGN PATENT DOCUMENTS

| | | |
|---|---|---|
| 72426 | 2/1976 | Australia . |
| 68034 | 8/1976 | Australia . |
| 27038 | 1/1979 | Australia . |
| 57284 | 10/1980 | Australia . |
| 65929 | 8/1981 | Australia . |
| 2333584 | 7/1977 | France . |
| 2608997 | 9/1977 | Germany . |

OTHER PUBLICATIONS

Publication—A Negative print of Australian Design Registration No. 68,034.

*Primary Examiner*—Deborah Jones
*Assistant Examiner*—Jennifer McNeil

[57] ABSTRACT

A roller assembly including a frame including first and second arms spaced apart from each other, each first and second arm having an inner and outer side and a mounting projection located on the inner side of each arm, each mounting projection having a proximal portion adjacent the arm on which it is located and a distal portion located away from the arm, the distal portion having a smaller diameter than the proximal portion, a first elongate shaped plate having an aperture rotatably mounted to the inner side of the first arm, the proximal portion of the mounting projection on the first arm extending through the aperture rotatably mounted to the inner side of the second arm, the proximal portion of the mounting projection on the second arm extending through the aperture in the second plate, each plate being adapted for connection to opposing ends of two or more rollers so as to permit rotatable mounting of the rollers to the plates and to hold the two or more rollers substantially in a single plane, the plates and the rollers connected thereto being rotatable through 360°, each plate being detachable from one of the first and second arms to permit a single roller to be mounted to the mounting projections of the first and second arms by locating the distal portion of each mounting projection in a passage in each opposing end of the single roller, and a handle connected to the frame for holding the assembly, the handle positioned at an angle to the plane or positionable at an angle to the plane.

14 Claims, 4 Drawing Sheets

ASSEMBLY FOR ROLLERS

The present invention is directed to an assembly that can be fitted with two or more rollers for applying paint and other liquids to a surface.

To apply paint to a large area it can be more convenient to use a roller brush than a typical paint brush having bristles. Roller brushes usually include a roller rotatably mounted at one end to an arm attached to a handle. The roller is submerged in a tray containing paint and rolled over a surface, the paint on the roller thereby being applied to the surface. Whilst a roller brush enables the user to quickly apply paint to a wide area, typically the coverage of paint in a first application is often uneven and incomplete. Accordingly, it can be necessary to run the roller brush over the same area a number of times to obtain a smooth coverage of paint.

The present invention seeks to overcome or at least diminish the disadvantages with these types of roller brushes.

Throughout this application, the term "roller" is defined to mean a cylindrically shaped object having two opposing ends and an outer surface, and having on the outer surface a layer of synthetic or natural fibres or other material than can pick up a coating of a liquid. By rolling the roller coated in a liquid over a surface, the liquid is applied to the surface. Such liquids can include paint, ink, varnish glue etc.

According to one aspect of the present invention there is provided an assembly suitable for holding two or more rollers each having opposing ends, said assembly including:

a frame suitable for connection to the opposing ends of two or more rollers o as to permit rotationable connection of the two or more rollers to said frame and to locate two or more of the rollers substantially in a single plane;

and means connected to the frame for holding said assembly, said means positioned at an angle to said plane or positionable at an angle to said plane.

In use, two or more rollers can be attached to the assembly and the rollers are dipped in a material that is to be applied to a surface. The rollers being located in a single plane can then be placed in contact with a surface and the skilled addressee will appreciate that if the surface is itself planar, the plane of the rollers will be parallel with the plane of the surface. The holding means is located at an angle to this plane or is locatable at an angle so that the handle extends away from the planar surface to be coated. This allows the user to grip the holding means and move the assembly with rollers attached thereto over the surface to permit the coating material to be applied to the surface.

The present inventor has found that the use of this assembly with two or more rollers attached thereto can provide a more even and complete coverage of paint etc. to a surface than the use of the one roller brush device described above. This is because the two or more rollers provide a greater area of contact with a surface to be painted than one roller so that a greater amount of paint etc. can be applied to a surface in a single application. This can substantially reduce the time taken to apply paint etc. to a surface and the need for repeated application of a roller over an area is reduced. Furthermore, the inventor has found that the assembly having two or more rollers fitted thereto is more stable and easier to control than the typical one roller brush as described above. These features greatly assist in the painting of difficult areas, such as ceilings.

The inventor has also found that force applied to the assembly, through the holding means attached to the frame can be transmitted evenly to both ends of the rollers as the frame is attached to both ends. Thus a more even force is applied to the rollers then is applied to the single roller brush described above where the roller is connected at only one end to a handle. This even application of force to the rollers further assists in providing an even coverage of paint etc. to a surface.

In a preferred embodiment, the frame includes:

first and second arms spaced apart from each other;

a first attachment means rotatably mounted to the first arm; and a second attachment means rotatably mounted to the second arm.

In this preferred embodiment the first and second attachment means are adapted for connection to opposing ends of the two or more rollers so as to permit rotatable connection of the two or more rollers to the first and second attachment means.

As the first and second attachment means are rotatable relative to the first and second arms, the angle of the holding means relative to the plane of the rollers when mounted to the attachment means can be varied.

In a further preferred embodiment the first and second arms have inner and outer sides and the attachment means are mounted to the inner sides. Thus the attachment means and rollers fitted thereto can be rotated through 360° where the arrangement of these parts is located entirely within the boundary of the first and second arms and there is no impediment to the rotation.

It is preferred that the first and second attachment means are elongate members, more preferably elongate plates. It is preferred that the elongate members are connected to the first and second arms at the centre point of the members and that they are configured so that a roller may be mounted toward each end of the members at an equal distance from the centre point of the members.

The first and second attachment means may be rotatably mounted to the first and second arms in a number of ways. The following description is of a preferred method of connection of the first attachment means to the first arm. It will be appreciated that the second attachment means can be connected to the second arm in an identical fashion.

In this preferred embodiment, a mounting projection is located on the inner side of the first arm. More preferably the projection has a circular cross-section and is located toward the end of the arm. An aperture is located in the attachment means. The attachment means is rotatably mounted to the arm by locating the projection in the aperture, the projection thus acting as an axle about which the attachment means may rotate. It is also preferable to provide a spacing means at the base of the projection to provide an abutment surface located away from the inner side of the arm. The attachment means mounted on the projection may come into contact with this abutment surface and is thereby held away from the inner side of the arm and does not contact this inner side. This arrangement assists in providing a freer rotation of the attachment means about the projection.

In a preferred embodiment, the attachment means are removable from the first and second arms. Further, where the attachment means are located on mounting projections on the first and second arms, it is preferred to provide retaining means on each projection to assist in holding each attachment means in position when it is located on a projection. In one embodiment, a protrusion such as a flange or lug may be located on the projection and the projection is resiliently compressible into a first shape to permit the attachment means to be mounted onto the projection so that the protrusion is located on the far side of the attachment means. On release of the compressive force, the projection resumes its normal shape whereby the protrusion functions to provide an interference fit to prevent the removal of the attachment means from the arm. The projection may be resiliently compressible by making it from a resiliently compressible material. Furthermore, a slot may be provided in the projection to permit it to be compressed.

The rollers may be rotatably mounted to the first and second attachment means in a number of ways and it is preferred to mount them in a similar fashion to the mounting of the attachment means to the arms. Accordingly in a preferred embodiment mounting projections, preferably having a circular cross section, are located on the sides of each attachment means so that the projections face each other when the attachment means are mounted to the first and second arms. The projections are configured so that they may be inserted in apertures or bores located in the ends of a roller. In this way the projections function as axles about which the rollers may rotate. To allow for two rollers to be mounted, two projections are located on each attachment means. It also preferred to provide spacing means at the base of each projection, the spacing means providing an abutment surface against which the end of a roller may contact when mounted so that the end of the roller is held away from the surface of the attachment means. This arrangement provides for freer rotation of the roller about the projection.

In a preferred embodiment, the holding means includes a gripping portion and at least this portion is located at an angle to the plane of the rollers or is locatable at an angle to said plane. Accordingly, the holding means may be a handle and it is also preferred that the handle extends in a direction that is substantially perpendicular to the longitudinal axes of the rollers when mounted to the frame. Where the frame includes first and second arms the handle may be attached to either or both arms. It is further preferred that the first and second arms are approximately L-shaped and extend from opposite sides of the handle.

When two or more rollers are to be attached to the assembly of this invention, it is preferred that the frame is adapted to hold the rollers so that their longitudinal axes extend in substantially the same direction and parallel to one another.

The two or more rollers attached to the first and second attachment means can rotate relative to the arms and handle of the assembly. This allows the rollers mounted to the assembly to be maintained in contact with a surface being painted etc. no matter what angle the handle is positioned relative to the surface.

In some circumstances it may be preferable to mount only one roller to the assembly. This may be appropriate where only a light coat of paint etc. is to be applied to a surface. Where only a single roller is mounted to first and second attachment means, the rotation of these means could interfere with the operation of the single roller. Therefore, in a further preferred embodiment, the assembly includes a fastening means to limit or stop the rotational movement of the first and/or second attachment means. Where a roller is mounted to the first and second attachment means, the first and second attachment means and roller will rotate together as a single unit. Accordingly, to prevent rotation of this unit, the fastening means need only act directly on one of the attachment means. However, two fastening means may be provided, one to act directly on each attachment means.

The fastening means may comprise a pin which can be fitted to the assembly so that it contacts an arm of the assembly and the attachment means adjacent this arm so as to limit or stop the rotational movement of both attachment means and roller. Preferably two pins are used, one pin being fitted to the first arm and the other to the second arm.

In an alternative embodiment, where the first and second attachment means are removable from the first and second arms, a single roller may be mounted to the mounting projections located on the first and second arms. In this embodiment, it is preferred that the mounting projections on the first and second arms are stepped so that each projection has two sections of different diameters. The distal section of the projection is of smaller diameter than the proximal section (ie that section immediately adjacent the side of the arm). Accordingly, the distal section may function as a mounting projection for a roller. In a preferred embodiment a retaining means as described earlier is located on the proximal section and the mounting projection is resiliently compressible. The resiliently compressible nature of the mounting projection may be imparted by a slot located in the projection to permit a certain amount of compression of the projection. In this embodiment a compressive force is applied to the projection to reduce its diameter to permit the projection to be passed through the aperture of an attachment means so that the retaining means is located beyond the aperture. When the compressive force is released, the mounting projection resumes its normal shape and the retaining means holds the attachment means in position via an interference fit.

In another aspect, this invention is directed to an assembly as hereinbefore described having one or more rollers mounted to the assembly. In a preferred embodiment, two rollers are mounted to the assembly.

The rollers for use with this invention are preferably cylindrical tubes having applied to the outer surface a layer of synthetic or natural fibre for the take-up of a liquid material such as paint, etc. The roller is preferably hollow. In a preferred embodiment a cap is fitted at each end of the roller either substantially inside or outside the roller to prevent or hinder the entry of liquid into the roller. This is preferred as liquid inside the roller can increase its weight making it harder to handle. Furthermore, liquid exiting from the inside of the roller can drip, thereby spoiling the appearance of a surface that has just been painted etc.

In a preferred embodiment, the end cap has a circular cross section, having a circular outer side wall or skirt and can be fitted substantially within the roller. The cap may of a diameter to cause an interference fit with the inner walls of the roller. This fit may be enhanced by the addition of a sealing member to be used in conjunction with the end cap. For example, an O-ring may be placed around the side wall of the cap to improve the interference fit between the cap and roller thereby providing a better seal. If an O-ring is used, it is also preferred to place a groove in the side wall of the cap toward an end of the end cap. The groove should be of a sufficient depth that the O-ring can sit in the groove and extend beyond the level of the side wall. The groove assists in maintaining the O-ring in position around the end cap.

In a preferred embodiment of this invention where there are attachment means having projections which function as axles, an aperture is located in the end of the cap for receiving a projection. Alternatively, there may be a passage opening at the outer end of the cap for receiving a projection. Preferably the passage is closed at one end so that paint etc. cannot enter the interior of the roller through the passage.

Where a spacing means is located at the base of each projection positioned on the attachment means, each spacing means provides an abutment surface that can bear against the surface of the end of a cap to hold the end cap and roller apart from the surface of the attachment means. The end of the cap may include a recessed area into which the spacing means may partially extend when the roller is fitted to the attachment means. This arrangement reduces the risk of the projection located in the end cap levering the end cap off the roller if a lateral force is applied to the projection.

In another embodiment the present invention is directed to a roller for fitting to an assembly as described above, said roller having;

a cylindrical body having an interior space and opposing ends; and an end cap fitted to each opposing end, each end cap having a passage having a single opening located at an end of the end cap for receiving a mounting projection located on the assembly, wherein said caps prevent the entry of liquid into the interior space of the cylindrical body.

In preferred embodiments the roller has one or more of the preferred features as described above.

BRIEF DESCRIPTION OF THE DRAWINGS

The invention shall now be described with reference to the following Figures which illustrate a preferred embodiment of the invention:

Turning to FIG. 1, assembly 1 includes L-shaped side arms 2 and 3 attached to handle 44. Side arms 2 and 3 have inner walls 2*a* and 3*a*respectively. Extending from inner walls 2*a* and 3*a* and positioned near the end of arms 2 and 3 are circular cross-section projections 4. Each projection 4 has an enlarged head 5 which functions as a retaining means. The projections 4 are made of a resilient material and a slot 6 is located in each projection 4. Thus, when a compressive force is applied to the outside of a projection 4, the diameter of the projection 4 can be reduced and when the pressure is released the projection 4 can resume its normal diameter. At the base of each projection 4 there is located a spacing means 7 which is a step having abutting surface 8. Aperture 9 is located in side arms 2 and 3. Mounted to arms 2 and 3 are attachment means 10 and 11 respectively which are elongated plates. The plates 10 and 1 1 are identical and have rounded ends to assist in the run-off of paint etc. from the plates. In an alternative embodiment the plates 10 and 11 may also have flattened ends. The arms 2 and 3 and plates 10 and 11 form the frame 1*a* of the assembly 1 as referred to in this specification.

Figure 1:
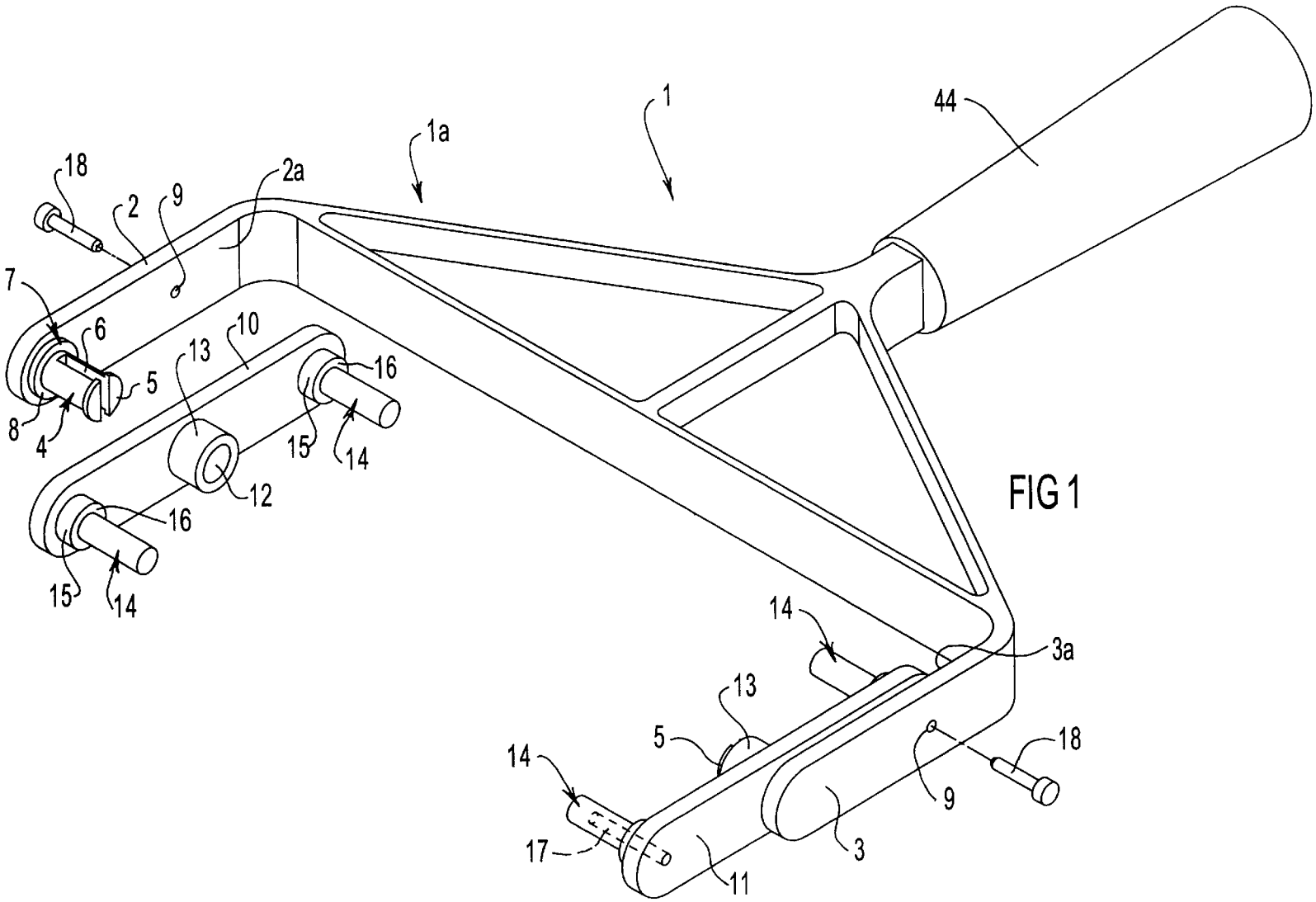
FIG. 1 shows a view of an assembly of this invention.

Located about center of each of plates 10 and 11 is an aperture 12 and located around each aperture 12 is a collar 13. The plates 10 and 11 are mounted to the arms 2 and 3 by locating the projection 4 through aperture 12 and collar 13 of each plate. The heads 5 have a diameter greater than the diameter of apertures 12 and collars 13. By applying a compressive force to the sides of a projection 4, its diameter can be reduced thereby allowing the head 5 of the projection to be passed through an aperture 12 and collar 13 so that head 5 can be located on the opposite side of collar 13. When the compressive force is released, the projection 4 resumes its normal diameter and the head 5 assists in retaining the plate in position. Thus, projections 4 act as axles about which the plates 10 and 11 can freely rotate, The abutment surface 8 of each step 7 bears against the plates 10 and 11 which are thereby held slightly away from inner walls 2*a* and 3*a*. This assists in allowing freer rotation of the plates 10 and 11 .

Towards the ends of plates 10 and 11 there are located projections 14. The projections 14 are located an equal distance from the center point of each plate 10 and 11. At the base of each projection 14, there is located a spacing means which is a step 15 having abutment surface 16. A passage 17 extends through each projection 14 and opens at one side of plates 10 and 11. When the plates 10 and 11 are mounted to arms 2 and 3, either of passages 17 in each plate 10 and 11 may be aligned with apertures 9 of the arms 2 and 3. This permits a pin 18 to be located in each aperture 9 and passage 17 to restrict the rotation of plates 10 and 11. The pins 18 and apertures 9 or passages 17 may be threaded.

Figure 2:
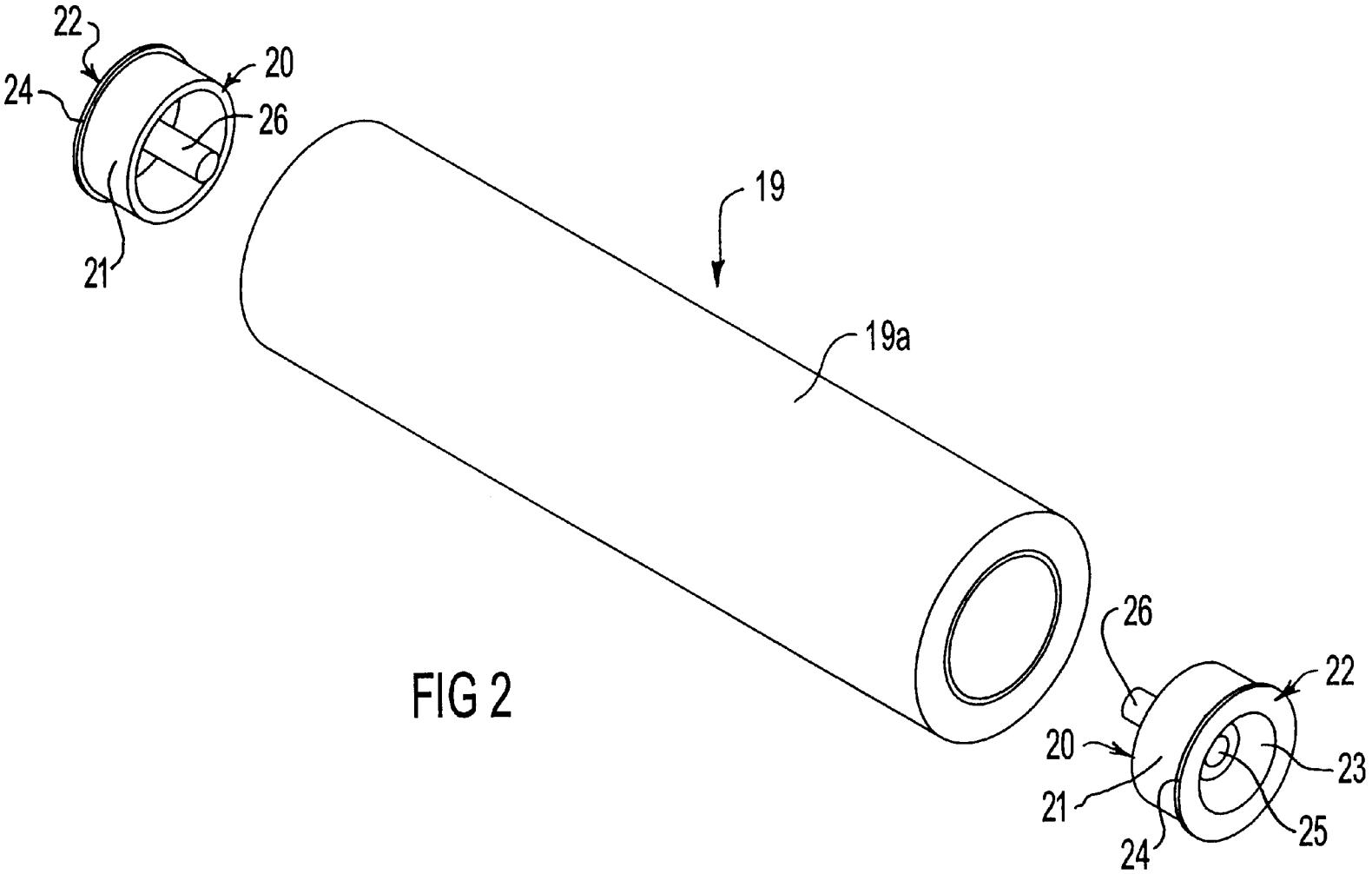
FIG. 2 shows a view of a roller for use with the assembly of FIG. 1.

FIG. 2 shows a roller 19 that may be fitted to the assembly of FIG. 1 . The roller 19 has a hollow cylindrically shaped body 19*a* and an end cap 20 may be located substantially within both ends of roller body 19*a*. End cap 20 is circular in cross section, the diameter of the end cap 20 being approximate the inner diameter of roller body 19*a* so that there is an interference fit between roller 19 and end cap 20. The curved side wall of the end cap 20 is designated 21. In an alternative embodiment a groove (not shown) is located in side wall 21 and extends all the way around the end cap 20. An O-ring (not shown) can be accommodated in this groove. The O-ring assists in creating a better seal between end cap 20 and inner wall of the roller body 19*a*. Outer end 22 of the end cap 20 includes a frusto-conical recessed area 23 and flange 24. Opening into area 23 is a blind passage 25 formed by column 26.

Figure 3:
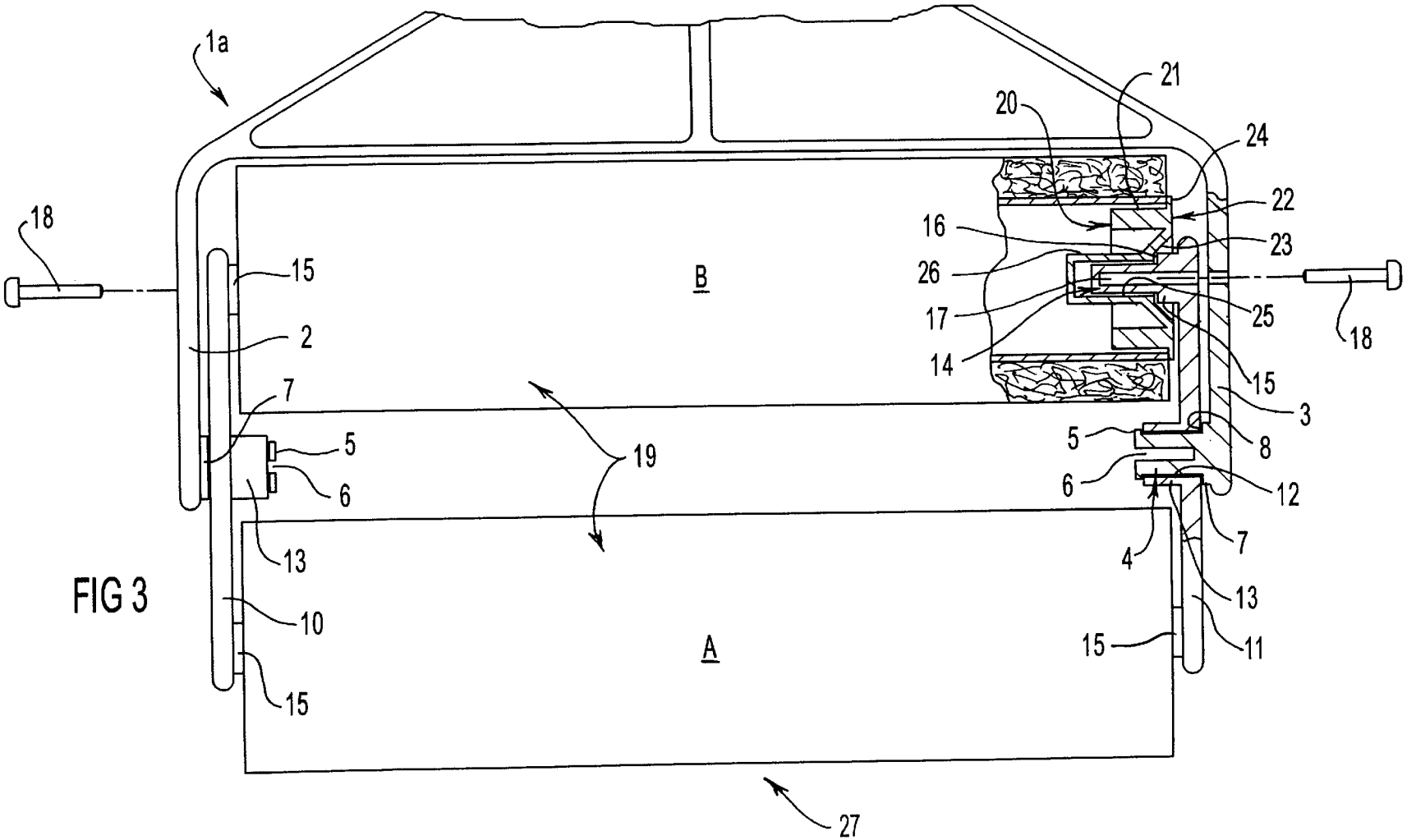
FIG. 3 is a view of the assembly of FIG. 1 having two rollers attached thereto.

FIG. 3 is a view of an assembly 1 of this invention having two rollers 19 as shown in FIG. 2 fitted thereto to form a paint roller device 27. The rollers 19 are designated A and B. The rollers 19 are fitted thereto by locating projections 14 in the passages 25 of the end caps 20 of each roller 19. Thus the projections 14 act as axles about which the rollers 19 can rotate. The abutment surfaces 16 can bear against the outer ends 22 of the caps 20 so that the rollers 19 are held slightly apart from the elongate plates 10 and 11. This assists in the free rotation of the rollers 19.

It is preferred that the side arms 2 and 3 are made of a resilient material so that on an application of force the arms 2 and 3 can be pulled apart slightly to increase the spacing between the plates 10 and 11 mounted to arms 2 and 3 One end of the rollers 19 can then be fitted to either plates 10 or 11. Then when the force is released, the arms 2 and 3 move back to their normal position and the other end of the rollers 19 can be fitted to the opposite plate.

It is preferred that the handle 44 and arms 2 and 3 are integral.

The assembly 1 holds the two rollers 19 parallel to each other and perpendicular to the axis of the handle 4. This allows for easier operation of the device 27.

A tray filled with paint can be used with device 27. Firstly, the rollers 19 are dipped in the paint in the tray. Both rollers 19 of the device 27 are then placed on a surface and the device 27 is moved over the surface so that the paint is transferred to the surface. Thus when the device 27 is moved in a forward direction, roller A applies a first coat of paint to a surface and roller B then applies a second coat thereby ensuring a more complete application of paint to the surface than is achievable by using a single roller brush. During this operation the angle of the handle 44 to the surface will change. However as the rollers 19 and plates 10 and 11 can rotate as a unit relative to the handle 44, both rollers. 19 can be maintained in contact with the surface no matter what angle the handle 44 is located relative to the surface. This ensures a maximum amount of paint is applied to the surface in a single application.

In some operations it may be preferable to fit only one roller 19 to the assembly 1. For example, this may desired where only a light coat of paint is to be applied to a surface. In this operation it is preferred to stop the rotation of plates 10 and 11 to prevent them coming in contact with the surface to be painted. This can achieved by locating a pin 18 in each aperture 9 and passage 17 Roller B is removed. Thus the device operates as a single roller brush.

Figure 4:
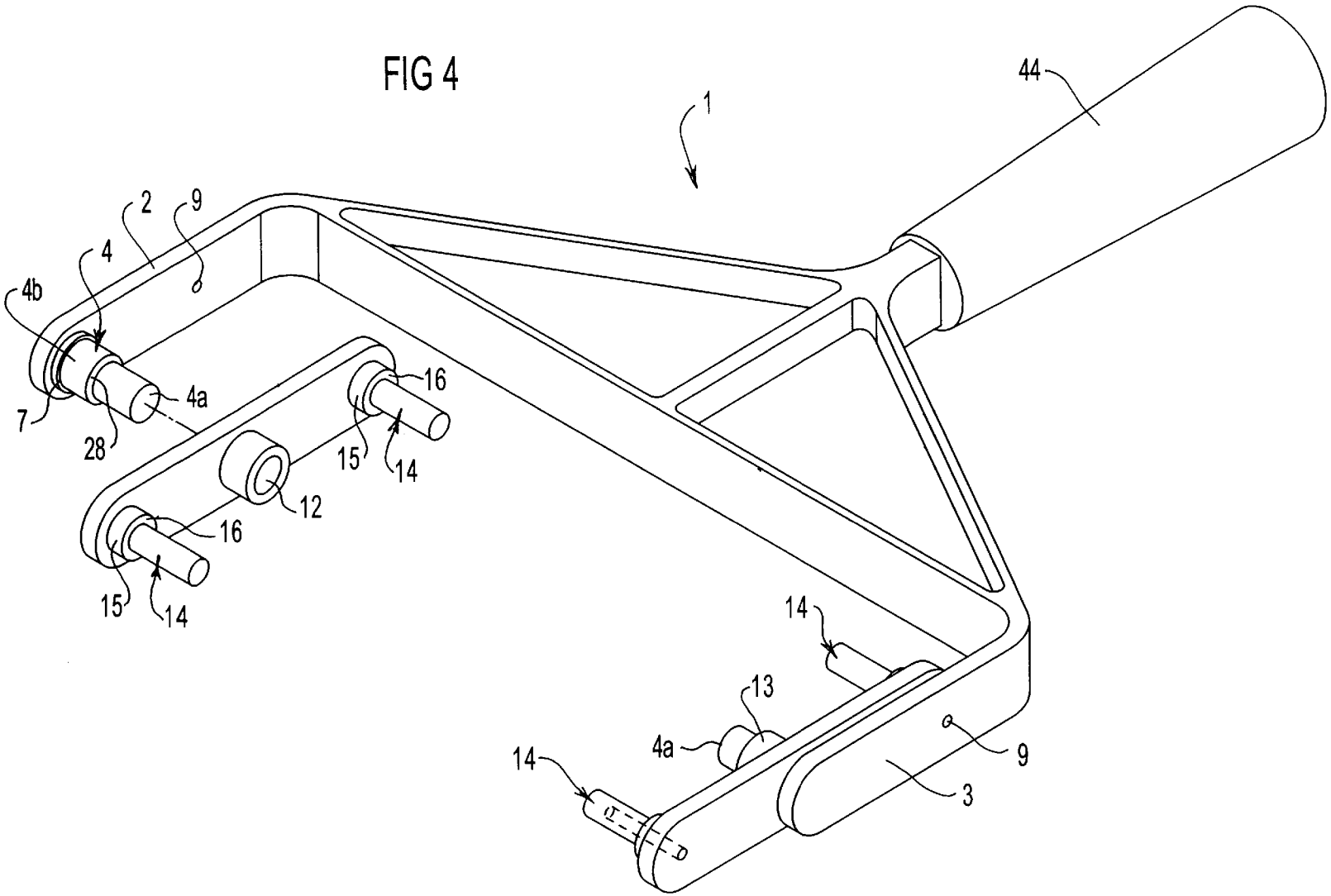
FIG. 4 shows a view of an alternative embodiment of part of the assembly of the invention.

In FIG. 4 there is illustrated an alternative embodiment of assembly 1 shown in FIGS. 1 to 3. The assembly 1 varies in the shape of the mounting projections 4 located on arms 2 and 3.

Each mounting projection 4 has a distal section 4*a* and proximal section 4*b* of different diameters. An abutting surface 28 is formed by the stepped configuration.

Plates 10 and 11 are mounted to the arms 2 and 3 in the following manner. Each projection 4 is located in the aperture 12 of the plate 10 or 11 so that the distal portion 4*a* extends beyond the collar 13. Rollers 19 are fitted between plates 10 and 11 as described earlier.

The plates 10 and 11 can be removed from projections 4 by sliding them off the projections 4 With the plates 10 and 11 removed, a roller 19 as illustrated in FIGS. 2 and 3 can be directly mounted on projection 4 The distil section 4*a* of each projection is inserted in passage 25 of the end caps 20 of the roller 19. In this manner the distal portions 4*a* function as axles about which the roller 19 can rotate. Abutting surface 28 of each projection 4 abuts outer ends 22 of the caps 20 to hold the roller 19 away from the arms 2 and 3.

It should be understood that various modifications and variations may be made to this invention as hereinbefore described without departing from the spirit and ambit of the invention.

The claims defining the invention are as follows:

1. Another assembly including:

a frame including first and second arms spaced apart from each other, each first and second arm having an inner and outer side and a mounting projection located on the inner side of each arm, each mounting projection having a proximal portion adjacent said arm on which it is located and a distal portion located away from said arm, the distal portion having a smaller diameter than the proximal portion, a first elongate shaped plate having an aperture rotatably mounted to the inner side of the first arm, said proximal portion of said mounting projection on said first arm extending through said aperture in said first plate, a second elongate shaped plate having an aperture rotatably mounted to the inner side of the second arm, said proximal portion of said mounting projection on said second arm extending through said aperture in said second plate, each plate being adapted for connection to opposing ends of two or more rollers so as to permit rotatable mounting of the rollers to said plates and to hold said two or more rollers substantially in a single plane, said plates and said rollers connected thereto being rotatable through 360°, each plate being detachable from one of the first and second arms to permit a single roller to be mounted to the mounting projections of the first and second arms by locating the distal portion of each mounting projection in a passage in each opposing end of the single roller, and means connected to the frame for holding said assembly, said means positioned at an angle to said plane or positionable at an angle to said plane.

2. The assembly according to claim 1 wherein a retaining means is located on each mounting projection located on the first and second arms to retain each first and second plates in position on the mounting projections.

3. The assembly according to claim 2 wherein the retaining means is located on the proximal portion of each mounting projection.

4. The assembly according to claim 2 wherein each elongate plate has two or more mounting projections extending from a side, each mounting projection for insertion into an opposing end of a roller to permit rotatable mounting of two or more rollers to the plates.

5. The assembly according to claim 1 wherein each elongate plate has two or more mounting projections extending from a side, each mounting projection for insertion into an opposing end of a roller to permit rotatable mounting of two or more rollers to the plates.

6. The assembly according to claim 5 having one or more rollers mounted to the assembly.

7. The assembly according to claim 6 wherein each roller is a tube shaped member having opposing ends and a cap fitted to each end.

8. The assembly according to claim 7 wherein each cap has a passage for receiving one of the mounting projections located on the side of each elongate plate to permit rotational mounting of each roller to the assembly.

9. The assembly according to claim 8 wherein the passage in each end cap is closed at one end to prevent entry of liquid into the interior of the roller.

10. A roller assembly including:

a frame including first and second arms spaced apart from each other, each first and second arm having an inner and outer side, and a mounting projection located on the inner side of each arm, each mounting projection having a proximal portion adjacent said arm on which it is located and a distal portion located away from said arm, the distal portion having a smaller diameter than the proximal portion, a first elongate shaped plate having an aperture rotatably and detachably mounted to the inner side of the first arm, said proximal portion of said mounting projection on said first arm extending through said aperture in said first plate, and a second elongate shaped plate having an aperture rotatably and detachably mounted to the inner side of the second arm, said proximal portion of said mounting projection on said second arm extending through said aperture in said second plate, each plate being adapted for connection to opposing ends of two or more rollers so as to permit rotatable mounting of the rollers to said plates and to hold said two or more rollers substantially in a single plane, said plates and said rollers connected thereto being rotatable through 360°, means to stop the rotational movement of the first and second plates relative to the first and second arms, and means connected to the frame for holding said assembly, said means positioned at an angle to said plane or positionable at an angle to said plane.

11. The assembly according to claim 10 wherein a retaining means is located on each mounting projection located on the first and second arms to retain each first and second plates in position on the mounting projections.

12. The assembly according to claim 10 wherein each mounting projection has a proximal portion adjacent said arm on which it is located and a retaining means is located on the proximal portion of each mounting projection.

13. The assembly according to claim 10 wherein each elongate plate has two or more mounting projections extending from a side, each mounting projection for insertion into an opposing end of a roller to permit rotatable mounting of two or more rollers to the plates.

14. A roller assembly including:

a frame including first and second arms spaced apart from each other, a first elongate shaped plate rotatably mounted to the first arm and having two or more mounting projections extending from a side and a second elongate shaped plate rotatably mounted to the second arm and having two or more mounting projections extending from a side, two or more rollers rotatably mounted to said plates, each roller being a tube shaped member having opposing ends and a cap fitted to each end, each cap having a passage for receiving one of said mounting projections, the passage in each cap being closed at one end to prevent entry of liquid into the interior of the roller, said first and second plates holding said two or more rollers substantially in a single plane, and means connected to the frame for holding said assembly, said means positioned at an angle to said plane or positionable at an angle to said plane.

* * * * *